US012781306B2

(12) United States Patent
Riihimäki et al.

(10) Patent No.: US 12,781,306 B2
(45) Date of Patent: Nov. 3, 2026

(54) HYDROMETALLURGICAL PROCESS FOR WASTE MATERIALS OF THE ZINC AND STEEL INDUSTRIES

(71) Applicant: Teknologian tutkimuskeskus VTT Oy, Espoo (FI)

(72) Inventors: Teppo Riihimäki, Espoo (FI); Pirkka-Pekka Ollonqvist, Espoo (FI); Pertti Koukkari, Espoo (FI); Jussi Rastas, Espoo (FI)

(73) Assignee: Teknologian tutkimuskeskus VTT Oy, Espoo (FI)

( * ) Notice: Subject to any disclaimer, the term of this patent is extended or adjusted under 35 U.S.C. 154(b) by 349 days.

(21) Appl. No.: 18/710,624

(22) PCT Filed: Nov. 15, 2022

(86) PCT No.: PCT/FI2022/050746
§ 371 (c)(1),
(2) Date: May 16, 2024

(87) PCT Pub. No.: WO2023/089234
PCT Pub. Date: May 25, 2023

(65) Prior Publication Data

US 2025/0034677 A1 Jan. 30, 2025

(30) Foreign Application Priority Data

Nov. 16, 2021 (FI) ..... 20216173

(51) Int. Cl.
*C22B 7/02* (2006.01)
*C22B 1/00* (2006.01)
(Continued)

(52) U.S. Cl.
CPC ..... *C22B 7/02* (2013.01); *C22B 1/005* (2013.01); *C22B 3/08* (2013.01); *C22B 19/22* (2013.01)

(58) Field of Classification Search
None
See application file for complete search history.

(56) References Cited

U.S. PATENT DOCUMENTS 3,976,743 A 8/1976 Landucci et al.
4,219,354 A 8/1980 Fugleberg et al.
(Continued)

FOREIGN PATENT DOCUMENTS

EP 0709472 B1 6/1999
EP 2902510 A1 8/2015
(Continued)

OTHER PUBLICATIONS

Filippou: Innovative hydrometallurgical processes for the primary processing of zinc. Mineral Processing and Extractive Metallurgy Review, Jul. 1, 2004, vol. 25, No. 3, pp. 205-252.
(Continued)

*Primary Examiner* — Alexandra M Moore
(74) *Attorney, Agent, or Firm* — Laine IP Oy

(57) ABSTRACT

The present invention relates to a process for recovering zinc and iron products from zinc-containing waste materials obtained from the zinc or steel industry, or both, by first treating the waste material(s) with strong acid, to convert any zinc ferrites into leachable compounds, and then leaching the acid-treated material, neutralizing the acid of the leach solution, recovering zinc from the neutralized ferrous iron-containing solution, recovering iron from the thus obtained solution, and circulating at least a fraction of the raffinate solution obtained from the iron recovery back to the leaching step.

19 Claims, 3 Drawing Sheets

(51) Int. Cl.
*C22B 3/00* (2006.01)
*C22B 3/08* (2006.01)

(56) References Cited

U.S. PATENT DOCUMENTS 4,610,722 A * 9/1986 Duyvesteyn ..... C22B 17/04
423/163
2008/0271572 A1 11/2008 Lahtinen et al.

FOREIGN PATENT DOCUMENTS

KR 101959257 B1 3/2019
WO WO9421830 A1 9/1994
WO WO2006119611 A1 11/2006
WO WO2018109283 A1 6/2018
WO WO2021074124 A1 4/2021

OTHER PUBLICATIONS

Jha et al: Review of hydrometallurgical recovery of zinc from industrial wastes. Resources, Conservation and Recycling, Aug. 1, 2001, vol. 33, No. 1, pp. 1-22.

* cited by examiner

HYDROMETALLURGICAL PROCESS FOR WASTE MATERIALS OF THE ZINC AND STEEL INDUSTRIES

BACKGROUND OF THE INVENTION

Field of the Invention

The present invention relates to a hydrometallurgical method for the treatment of waste materials of the zinc or steel industries, such as arc furnace dust, as well as for recovering zinc and iron from said materials as their sulphide and sulphate.

Description of Related Art

Nearly 50% of the zinc currently produced in the world is used in prevention of corrosion by galvanizing, whereby the zinc will eventually be discarded with the steel scrap, and the components recovered for example in electromelting-type processes of the steel industry. Along this processing, zinc becomes evaporated and oxidized, and is carried away to be collected in dedusting devices. One ton of smelted steel scrap produces about 15-25 kg of dust, in which the content of zinc is 15-40%.

The electric arc furnace (EAF) kiln is a commonly used alternative for processing galvanized steel and other steel scrap. The electric arc furnace (EAF) produces dust that contains zinc, iron and harmful compounds. The dust can be recycled, but the recycling rates could still be improved. Large amounts of the EAF dust currently produced is still disposed of in landfills.

Due to environmental concerns, increasing restrictions on zinc residue management have emerged. The major technology for recycling the EAF dust and recovering the zinc is based on using the Waelz kiln treatment (see e.g. EP 0709472 B1), which is not a simple process and has a high energy consumption, a high carbon footprint and produces a high amount of iron-containing waste, the disposal of which is challenging.

Further development of recycling technologies for EAF dust have not been particularly successful, when compared with the Waelz process. However, though the latter has proved to be a commercial success, it also generates a significant amount of gangue, which in present EU regulations is considered a problem waste. Thus, there is an increased need for new processes.

Some research effort has recently focused on hydrometallurgical recycling of the EAF dust. Some of these hydrometallurgical processes utilize 'acid baking' treatment with hot concentrated sulfuric acid, which provides the suitable thermodynamic conditions for producing soluble Zn and Fe sulphates.

Processes that describe the leaching of zinc ferrite using strong acids are known e.g. from KR 101959257 B1. However, this process combines the acid leaching with magnetic separation for zinc recovery, whereby the process is clearly not very specific. Thus, the process for the recovery of valuable components from zinc dust can be developed further.

WO 2018109283 A1 describes the acid treatment of the zinc waste with sulphur dioxide ($SO_2$) addition to ensure the dissolution of iron as ferrous ions. The obtained leachate will then contain the iron and the zinc, while the undissolved part will contain e.g. lead and calcium. Following such division, the recovery of zinc and iron as their hydroxides and oxides from the filtrate can then be performed by conventional hydrometallurgical means e.g. by using conventional reagents, such as $Ca(OH)_2$, MgO, NaOH and $NH_3$. By choosing products based on sulphide and sulphate, the usage of such reagents can be avoided and the process further improved.

Constantly increasing amounts of waste have become a serious issue for zinc producers, and an environmental problem. On the other hand, the valuable elements contained in zinc wastes also constitute a considerable potential value. There is thus an existing need for a procedure for removing, or at least considerably reducing, the waste problem in an economical manner, and simultaneously utilizing a higher portion of the substances of the dust.

Some hydrometallurgical treatments of EAF dusts exist, but these do not utilize the components of the dust in an optimal manner, and result in excess waste production. Thus, there is still a need for further developed treatment processes.

SUMMARY OF THE INVENTION

It is an object of the present invention to solve at least some of the problems related to the prior art.

Thus, according to a first aspect of the present invention, there is provided a process for recovering zinc and iron, and optionally lead, from recycled zinc-containing waste material of the zinc or steel industry, such as electric arc furnace dust (EAF-dust), in which materials the zinc is typically present as its oxide.

According to a second aspect of the invention, a process for recovering zinc and iron from recycled zinc-containing waste is achieved, resulting in low waste production, due to, among others, an optimized selection of reagents.

According to a third aspect of the invention, a more concise process is achieved, compared to prior art processes, wherein an inner iron circulation is achieved, also avoiding excessive use of conventional bases, such as ammonia ($NH_3$), sodium, calcium and magnesium bases.

The invention thus relates to a hydrometallurgical process for the treatment of waste materials of the zinc or steel industries, such as arc furnace dust, as well as for recovering zinc and iron from said materials as zinc sulphide and ferrous or ferric sulphate.

In this process, the EAF dust is treated with strong acid to sulphate the dust, thus also facilitating the subsequent leaching of zinc from the material. The process accomplishes low waste production since the process uses iron-based chemicals and has an inner iron circulation. Among others, metallic iron can be used for both reduction and neutralization, while optionally also iron hydroxides can be used for neutralizations.

Several advantages are achieved using the invention. Among others, the process produces only a low amount of waste, since the iron and zinc of the dust are converted to products. Further, the process has an inner iron circulation, which is a novel concept, and iron-based chemicals can be used in reductions and neutralizations. Thus, the only metal cations used in the main process chemicals (see FIG. 1) are iron and zinc ions. Due to the generation of hydrogen gas in the neutralisation, the process may also include a hydrogen recovery and circulation, whereby the hydrogen can be utilized to make hydrogen sulphide for the zinc sulphide (ZnS) precipitation.

The process has low energy consumption due to exothermic unit operations. All solid fractions separated from the process can be recovered and used. The only solid obtained from the process that is defined as a waste is the leach residue, which possibly could be used for lead recovery.

Further, the process is even capable of utilizing scrap iron, thus providing a further environmental benefit.

EMBODIMENTS OF THE INVENTION

Definitions

Figure 1:
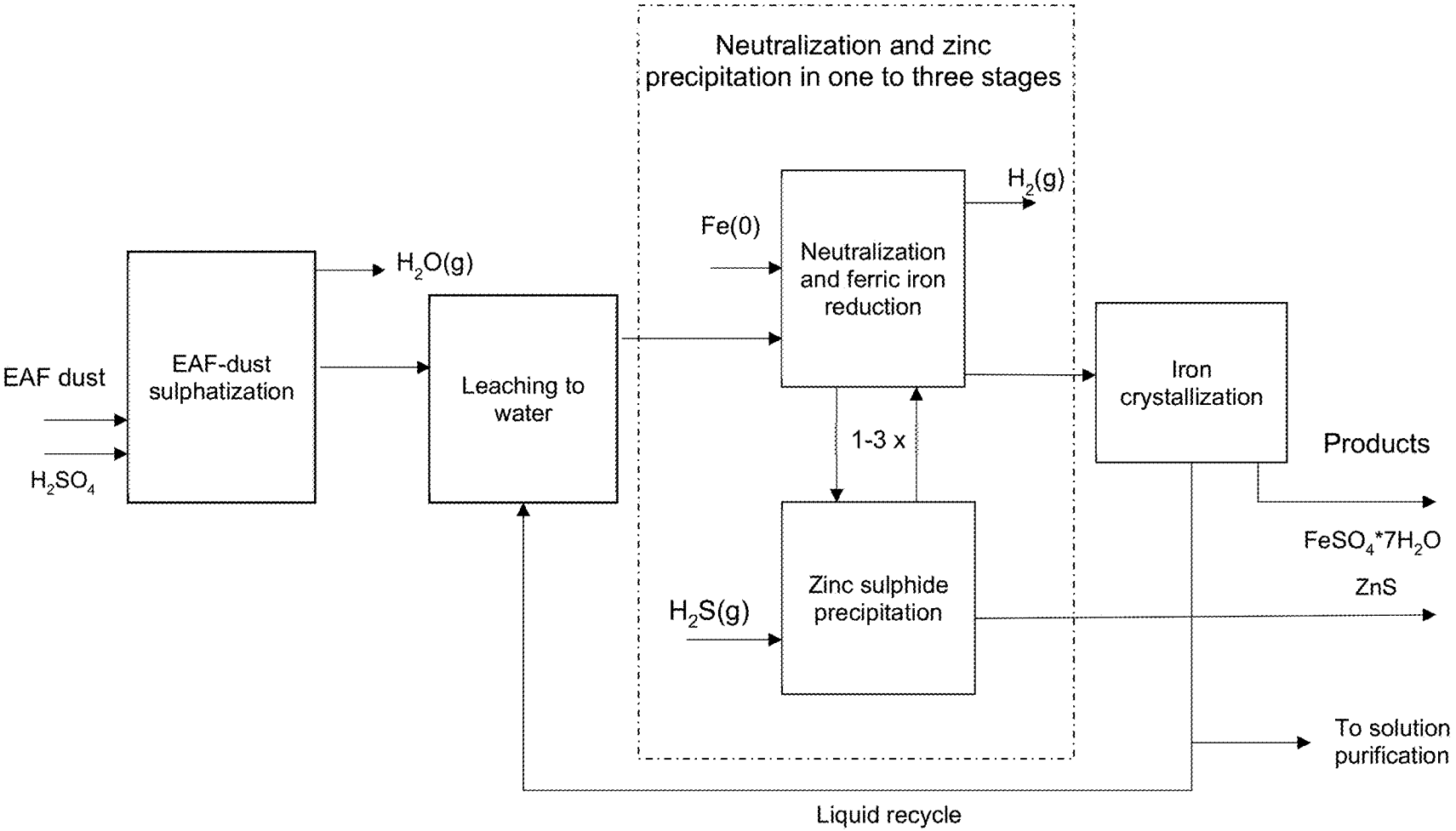
FIG. 1 is a block diagram illustrating the processing steps in accordance with at least some embodiments of the present invention.

The "hydrometallurgical processing" of the invention is intended to cover a multistep procedure for separating at least the valuable components from the starting material, i.e. the waste material, the procedure including steps of acidifying and leaching, as well as one or more steps of metals recovery.

The term "waste material" is intended to cover by-products of either metal production or metal recovery, particularly the zinc-containing by-products of the zinc and steel industries. A particularly preferred alternative is EAF dust.

A "leachable" sulphate compound, as used herein, is a sulphate compound that can be dissolved in a strong sulphuric acid solution. Examples of such compounds include the zinc, ferrous and ferric sulphates, i.e. the $ZnSO_4$, $FeSO_4$ and $Fe_2(SO_4)_3$.

The term "strong" sulphuric acid is herein used to describe the concentration of the acid as being non-diluted, or having a concentration of 62% by mass, or higher. Such strong sulphuric acids can have the following more precise definitions:

62-70% by mass, being named chamber acid, 78-80% by mass, being named tower acid, 93.2% by mass, being named 66° Baume acid, and 98.3% by mass, being named concentrated sulphuric acid.

Thus, the present invention relates to a process for recovering zinc and iron products from zinc-containing waste materials obtained from the zinc or steel industry, or both (shown in FIG. 1 for EAF dust), by first treating the waste material(s) with strong sulphuric acid, to convert zinc, iron and other oxide compounds into leachable sulphate compounds, and then leaching the acid-treated material in an aqueous solution, in order to provide a leach solution containing dissolved zinc and dissolved iron as sulphates, whereas lead sulphate is not dissolved, but instead remains in the leach residue, neutralizing the acid of the leach solution and reducing the iron in the solution further, by using an iron-based reagent, thus providing a neutralized leach solution, recovering zinc from a neutralized solution obtained from a preceding step in one or more steps of sulphide precipitation, preferably using hydrogen sulphide as reagent, in order to provide a zinc-deprived solution, and neutralizing the acid of the zinc-deprived solution obtained from the preceding precipitation step using an iron-based reagent, optionally recovering the hydrogen formed in the neutralization step to be used in a hydrogen sulphide generation, recovering iron from a solution containing reduced iron obtained from a previous step by sulphate crystallization, thus leaving a raffinate solution with a lowered iron concentration, and circulating at least a fraction of the raffinate solution obtained from the iron recovery back to the leaching step.

In the following, this sequence of steps are also referred to as the "main process".

Said process typically includes a formation of a water soluble sulphate mixture which is followed by a series of precipitations and crystallisations using e.g. sulfur-containing chemicals selected from sulfates, sulfides, sulfur oxides and sulfites, and hydroxides, in order to obtain an aqueous sulfur-containing raffinate solution, which preferably is recycled. Recycling the raffinate stream increases the recovery rates and decreases waste as well as wastewater production. However, since recycling also increases the impurity concentrations in the stream a solution purification of the recycle feed is preferred.

The waste material is typically selected from one or more zinc-containing by-products of the zinc or steel industries. A particularly preferred alternative is EAF dust comprising zinc and iron as its major metallic components.

In an embodiment, the waste material is EAF dust, mixed either before or after the acid treatment step with one or more further zinc-containing waste materials of the zinc or steel industries, preferably after the acid treatment, and optionally after mixing the material with a further waste material, such as goethite.

In another embodiment of the invention, a pre-treatment step is carried out on the zinc and iron-containing waste material, where it is washed with water to remove water-soluble alkali metal salts before the acid treatment, in order to decrease the concentration of alkali metals in the following streams and thus to reduce the requirement for solution purification.

Prior to the leaching step, the waste material is thus treated with a strong acid, preferably selected from sulphuric acid ($H_2SO_4$), more preferably in a concentration of at least 96 weight-% $H_2SO_4$, most suitably being hot concentrated sulphuric acid. This acid treatment provides the required thermochemical conditions for sulphate formation.

The acid treatment thus results in the sulphatization of the compounds of the waste material, e.g. as shown in the following reactions (1) and (2):

$$ZnFe_2O_4+4H_2SO_4 \rightarrow ZnSO_4+Fe_2(SO_4)_3+4H_2O \quad (1)$$

$$Fe_3O_4+4H_2SO_4 \rightarrow Fe_2(SO_4)_3+FeSO_4+4H_2O \quad (2)$$

Preferably, the acid is heated to a temperature of >100° C., particularly to about 200° C., and is mixed with the preheated (e.g. 100-150° C.) waste material. The temperature of the formed mixture then rises, typically to more than 250° C. As a result, the oxides in the waste are sulfatized to form a sulfate phase, while the halogenides also contained therein are decomposed, generally at least to a degree of 70%. When a heated acid is used, the temperature increases to a level where the water and the halogen hydrides of the formed mixture are transferred to the gas phase (also shown in FIG. 2) with 0.05 w-% or less chlorine or fluorine left in the solid sulphate. From the effluent gas the halogens can be removed, preferably using water washing.

The waste that has been sulphated in the acid treatment step is optionally mixed with further waste as described above, and is then dissolved into an aqueous solution, preferably a sulphate solution, more preferably a mildly acidic solution that does not cause the precipitation of metals, such as $Fe^{3+}$, while providing the desired leaching. The solution preferably has a pH of <3, and can for example be a dilute solution of sulphuric acid, typically having a concentration of <60 w-%.

The temperature during the leaching step is preferably more than 50° C., and more preferably less than 100° C., a particularly preferred temperature range being 80-90° C. These leaching conditions allow for both the zinc and the iron of the waste material(s) to form aqueous sulphates, while any lead of the raw material can be separated into an insoluble leaching residue containing the sparsely soluble sulphates of e.g. calcium (Ca) and lead (Pb), as well as well as respective silicates, silica and non-sulfatized iron oxides.

The leaching can thus be illustrated as shown in the following reaction (3):

$$ZnSO_4+FeSO_4+Fe_2(SO_4)_3 \rightarrow Zn^{2+}+Fe^{2+}+Fe^{3+}+SO_4^{2-} \quad (3)$$

After the leaching step, the formed phases are typically separated, and the solution phase, i.e. the leach solution, is carried to the following step of the process. The solid residue may be washed, whereby the washing solution may be added to the leach solution. The remaining solid residue typically contains the lead ($Pb^{2+}$) included in some raw materials.

Figure 2:
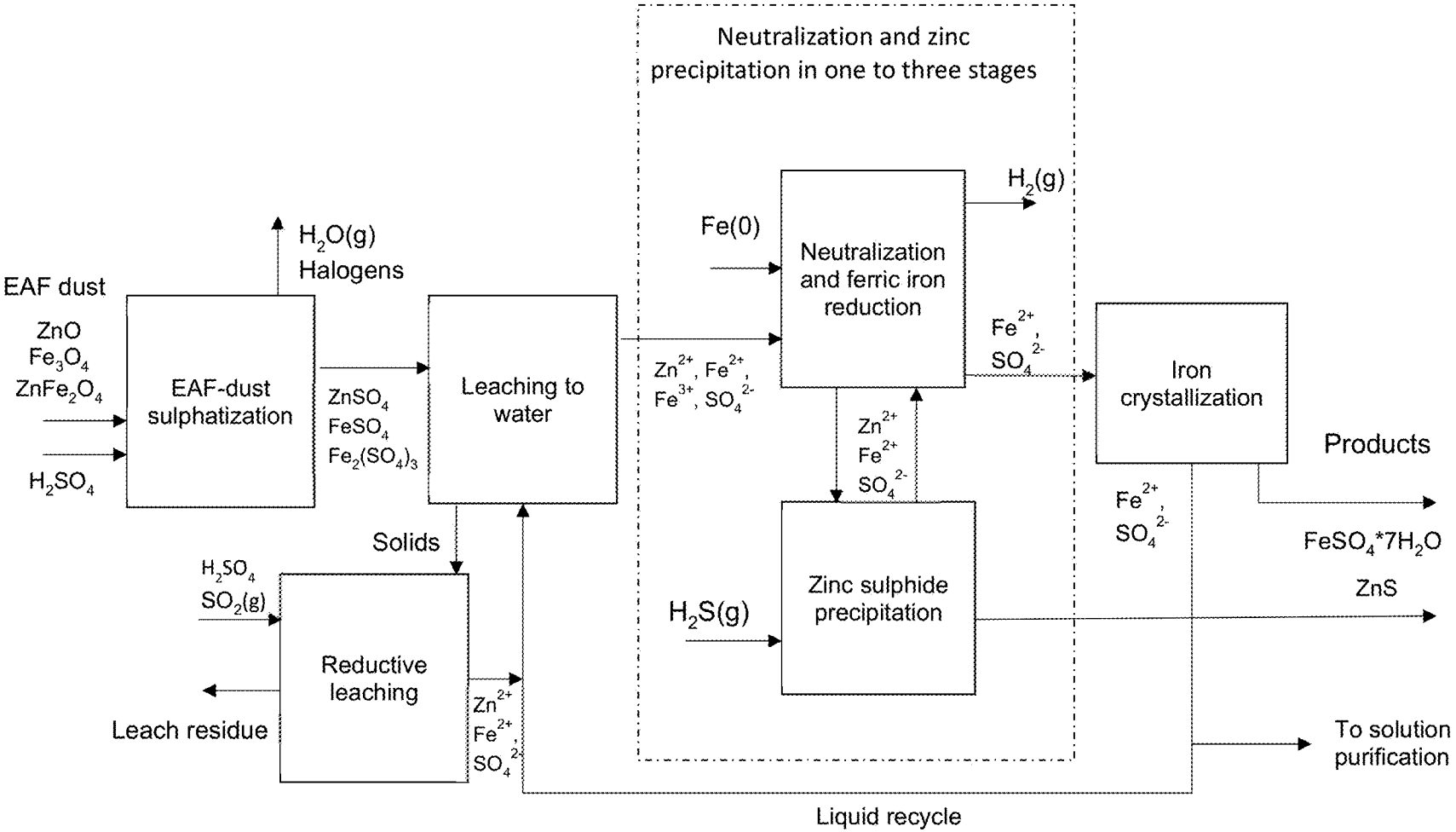
FIG. 2 is an alternative process flowsheet illustrating the process steps in accordance with a preferred embodiment of the invention.

In a preferred embodiment, as shown in FIG. 2, the solids obtained from the leaching step are treated in a further step of reductive leaching, preferably carried out with addition of sulphuric acid and sulphur dioxide. The obtained solution is preferably separated from the solid residue and recycled to the leaching step to be added to the leach solution. Using this optional further step, it is possible to obtain an even higher yield of zinc, iron and sulphates from the process.

The leach solution still contains a high content of acid. Thus, it is preferred to neutralize it. Further, to ensure reduction of the ferric ($Fe^{3+}$) iron to ferrous ($Fe^{2+}$) ions, required by the subsequent zinc separation, it is preferred to add metallic iron ($Fe^0$), e.g. as scrap iron, to the solution, said iron providing both pH and redox control. The addition of Fe will also provide the necessary neutralisation, preferably to a pH level of about 2.5-3.5 to allow for sulphide precipitation of zinc as zinc sulphide (ZnS). Neutralisation with metallic iron will evolve gaseous hydrogen ($H_2$), which can be either ventilated with excess air or nitrogen, or recovered for further use. The hydrogen can also be recycled in the process via an optional hydrogen sulphide generation step.

The reactions taking place during this neutralization and reduction step include, among other the following reactions (4) and (5):

$$2Fe^{3+}+Fe \rightarrow 3\ Fe^{2+} \quad (4)$$

$$Fe+2H^+ \rightarrow Fe^{2+}+H_2\ (g) \quad (5)$$

The subsequent steps of the process may thus involve the recovery of zinc, and iron, in quite pure form. Further, the process can also include steps for the recovery of further product fractions, such as fractions including nickel, cobalt and manganese. In order to provide further value to the waste material treatment process, it is, however, beneficial to recover at least zinc and iron product fractions.

Zinc may be recovered by precipitation, e.g. to form zinc sulphide, which has the further benefit of providing a quite pure sulphide product.

The iron may, in turn, be precipitated as a sulphate product.

The zinc recovery takes place as a precipitation, as shown in FIG. 1, preferably by adding hydrogen sulphide ($H_2S$). This reaction causes a reduction in the pH of the solution, whereby the precipitation is followed by a step of adjusting the pH of the solution so that no significant amounts of ferrous iron ($Fe^{2+}$) is precipitated at this stage of the process.

The reactions taking place during this zinc precipitation step include, among others the following reaction (6):

$$Zn^{2+}+H_2S\ (g) \rightarrow ZnS+H^+ \quad (6)$$

Thus, a solid residue is typically separated from a filtrate after the precipitation. The zinc-containing residue is preferably recovered, optionally after a washing step, whereas the filtrate typically is carried to the following step of the process.

The pH adjustment following the zinc precipitation preferably takes place by carrying out a similar neutralization as described above for the leach solution, using metallic iron. The gaseous hydrogen formed in the neutralization is preferably either ventilated with a shielding gas or recovered to be used to generate hydrogen sulfide ($H_2S$) for the preceding sulfide precipitation step.

The sequence including neutralisation and sulphide precipitation may take place in one or several steps, preferably using one to three zinc precipitations, more preferably two or three, each precipitation step followed by a neutralization step. While scrap iron is preferred for the pH neutralisation, using a hydroxide containing base is also possible, such as a FeO(OH) containing slurry, e.g. obtained from an optional subsequent solution purification step.

In a preferred embodiment of the invention, the zinc is recovered by two steps of hydrogen sulphide precipitation. The acid obtained from the zinc recoveries can either be collected and combined, followed by a single neutralization step, or the acidic solution can be neutralized after each zinc recovery, preferably using metallic iron. Preferably, the solution is neutralized after each recovery.

After the zinc precipitation step(s) the residual process stream comprises a mildly acidic ferrous sulphate solution with a limited amount of impurities that descend from the minority metals present in the original waste material.

In the following step of the process, the dissolved iron will be separated from the solution by crystallization to either ferrous or ferric sulphates, with their various hydrated forms, such as ferrous sulphate heptahydrate ($FeSO_4 \cdot 7H_2O$) or monohydrate ($FeSO_4 \cdot H_2O$). To enhance the crystallization process either evaporation, vacuum or cooling techniques may be used.

The reaction taking place during this iron crystallization step include, among others the following reaction (7):

$$Fe^{2+}+SO_4^{2-}+7H_2O \rightarrow FeSO_4*7H_2O \quad (7)$$

Optionally the ferrous/ferric sulphate solution may be recovered as an aqueous concentrate. A fraction of the ferrous or ferric sulphate solution may be precipitated into iron hydroxide.

Typically, a solid residue is, however, separated from a filtrate after the crystallization. The iron-containing crystals are preferably recovered, optionally after a washing step.

After the crystallisation, a raffinate solution remains, which typically consists of any filtrate remaining after iron crystallization, optionally combined with filter wash water.

This solution is then recirculated to the leaching step, optionally by carrying a fraction of the solution via one or more steps of solution purification.

In a further embodiment of the invention, it is possible to further precipitate the iron obtained from the iron crystallization as an iron hydroxide, which can then be utilized again as a neutralizing agent in the neutralization step(s).

As indicated above, it is also possible to recover further product fractions from the solution obtained from the iron crystallization, such as fractions including nickel, cobalt and manganese, in one or more steps of solution purification. Thus, said raffinate solution, obtained from the so-called main process described above, or a fraction thereof, can be fed to such further recovery steps.

Figure 3:
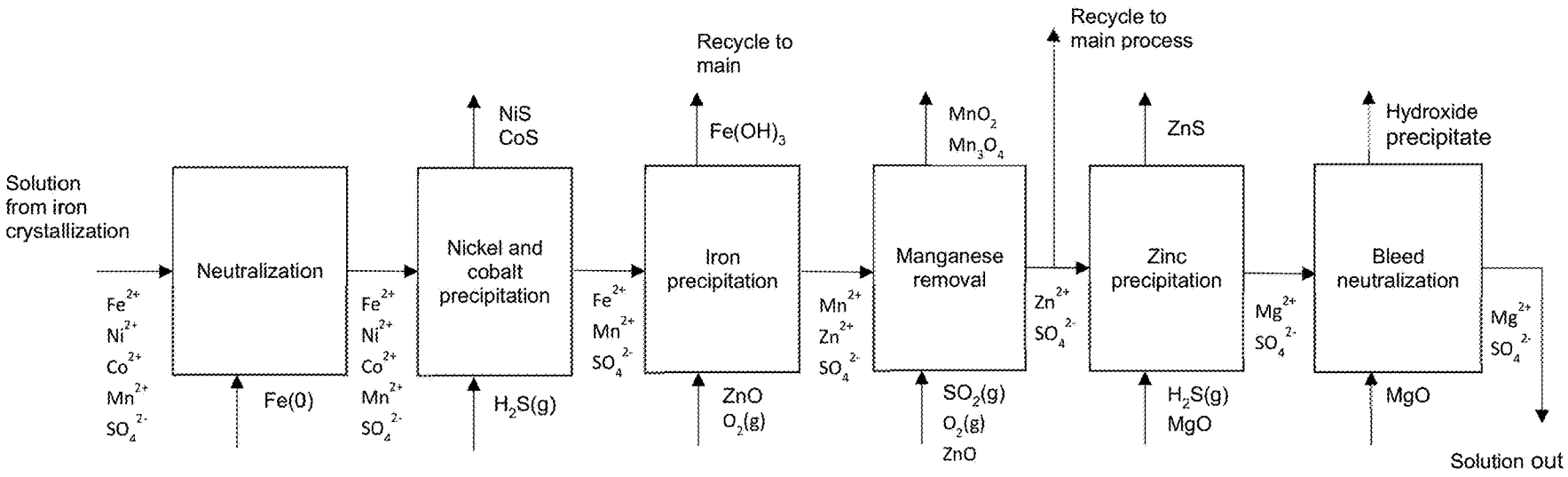
FIG. 3 is another process flowsheet illustrating the process steps in accordance with another preferred embodiment of the invention.

FIG. 3 illustrates a further embodiment of the invention, by showing said optional further steps of nickel and cobalt precipitation

- a further iron precipitation, followed by recycling a fraction of the remaining solution to at least one preceding neutralization step,
- manganese removal, followed by recycling a fraction of the remaining solution to a preceding zinc precipitation,
- a further zinc sulphide precipitation, followed by a combination and recovery of all zinc precipitates of the process, and
- a final bleed neutralization.

The optional solution purification thus consists of separating main impurities such as manganese, nickel and cobalt from the selected fraction of the solution obtained from the iron crystallization. Typically, the degree of impurity co-precipitation into the zinc and iron products will determine the allowable concentration of the impurities in the main process flow recirculated to the leaching step, and thus the size of the solution fraction separated from said recirculated solution to the solution purification.

In a preferred embodiment, 5-20 vol-% of the solution obtained from the iron crystallization step is fed to the solution purification, most suitably about 10 vol-%.

The solution purification may include several sub-steps, i.e. several unit operations, including neutralization, nickel and cobalt precipitation, iron precipitation, as well as manganese precipitation, preferably followed by zinc sulphide precipitation from a remaining bleed stream.

In an embodiment of the invention, nickel (Ni) and cobalt (Co) are separated from a fraction of the raffinate solution intended for purification. Before said separation, the solution is preferably neutralized, more preferably using an iron neutralization agent, as described above for the main neutralization step(s) of the process. The separation is preferably carried out by precipitation, more preferably by using hydrogen sulphide. This precipitation typically also includes a neutralization of the formed acid using iron. Magnesium compounds or other alkali reagents could also be used in this step, but the hydrogen sulphide and the iron are preferred, in order to maintain the chemical balance of the circulated solution. Thus, a solid residue is typically separated from a filtrate after the precipitation. The Ni/Co-containing residue is preferably recovered, optionally after a washing step, whereas the filtrate typically is carried to the following step of the process.

In another embodiment of the invention, a further fraction of iron is separated from a fraction of the raffinate solution intended for purification. This step is preferably carried out by precipitation, more preferably by oxidizing the ferrous iron and precipitating it as ferric hydroxide ($Fe(OH)_3$) or ferric oxyhydroxide ($FeO{\cdot}OH$). This precipitation forms acid, which may be neutralized, e.g. with zinc oxide, such as using a Waelz oxide. Such a neutralization also results in an increase of the zinc concentration of the solution. The filtrate is typically carried to the following step of the process. However, the obtained ferric precipitate is typically fed as an underflow back to the process for solution neutralization, preferably by feeding the precipitate to any of the main neutralizations shown in FIG. 2 (with exemplary lines shown in FIG. 4 for the first and third neutralizations). Thus, a solid residue is typically separated from a filtrate after the precipitation.

In a third embodiment of the invention, manganese is separated from a fraction of the raffinate solution intended for purification. This step is preferably carried out by oxidative precipitation, more preferably using a feed of oxidative gas, such as a mixture of oxygen gas and sulphur oxide gas ($O_2/SO_2$). Thus, a solid residue is typically separated from a filtrate after the precipitation, the residue containing the manganese(II) oxide, $MnO_2$, and the manganese(II,III) oxide, $Mn_3O_4$. The pH of the obtained filtrate is typically adjusted, e.g. using zinc oxide, to a level of 3-4, whereafter it can be carried to the following step of the process, or a fraction thereof can be recirculated to the main process, e.g. for use in a zinc precipitation step.

In a fourth embodiment of the invention, one or more of the above separations is carried out on the raffinate solution intended for purification, thus separating one or more of nickel and cobalt (Ni/Co), a further iron fraction and manganese, preferably in said order. More preferably, all three of said separations are carried out, most suitably in the given order. The remaining solution typically contains zinc in a relative high concentration. Thus, it is preferred to feed at least a main portion of this solution back to the main process for zinc recovery, preferably by recirculating it to one or more zinc precipitation step. However, the amount of recycle depends on the other impurities not recovered, such as sodium (Na) and magnesium (Mg) impurities. Typically, about 80 vol-% of the solution is recirculated back to the main process, when the concentration of e.g. impurities are low. However, at higher impurity concentrations, typically about 20 vol-% is recirculated. The residual amount of the solution is bleed, and is preferably treated further before it can be discarded requires zinc precipitation and solution neutralization.

In a fifth embodiment of the invention, the bleed solution is treated further to separate a further fraction of zinc therefrom, and subsequently to neutralize it, before the remaining solution can be discarded. Preferably, the zinc is precipitated as zinc sulphide using a similar reaction as in the zinc precipitation of the main process, e.g. proceeding via the addition of hydrogen sulphide ($H_2S$). Thus, a solid residue is typically separated from a filtrate after the precipitation. The zinc-containing residue is preferably recovered, optionally after a washing step, whereas the filtrate typically is carried to the following step of the process. Subsequently, the remaining solution is neutralized, e.g. using sodium sulphide. Also magnesium oxide or sodium hydroxide can be used, but the sodium sulphide is preferred in order to maintain the chemical balance of the process.

In a sixth embodiment of the invention, the remaining portion of bleed solution can be neutralized with any conventional neutralization reagent, such as calcium oxide or magnesium oxide, depending on the wastewater quality specifications. e.g. in terms of sulphate and chloride, and the neutralized solution can be discarded according to wastewater regulations.

Based on the above, according to a particularly preferred embodiment of the invention, the overall process includes the following steps:

- treating the waste material(s) with strong acid, to convert any zinc ferrites into leachable compounds,
- leaching the acid-treated material in an aqueous solution using metallic iron to convert any ferric iron into ferrous iron,
- recovering zinc by one or more steps of hydrogen sulphide precipitation,
- neutralizing the acid formed in the zinc recovery using metallic iron,
- optionally recovering the hydrogen evolved in the neutralization for its reuse,
- recovering iron by sulphate crystallization, optionally followed by precipitation into the iron hydroxide, and
- recirculating the acidic solution obtained from the iron recovery back to the leaching step, with a fraction thereof carried to the leaching step via one or more further purification steps, selected from
  - precipitating nickel and cobalt from a remaining portion of the acidic solution obtained from the iron recovery,
  - precipitating a further iron fraction, followed by recycling a fraction of the filtrate to at least one preceding neutralization step,
  - precipitating manganese from the remaining solution, followed by recycling a fraction of the filtrate to a preceding zinc precipitation,
  - precipitating a further fraction of zinc, followed by a combination and recovery of all zinc precipitates of the process, and
  - neutralizing the final bleed solution.

Since the major steps of the process can be carried out using reagents that are formed of some combination of iron, sulphates, sulphides and hydroxides, with iron being part of one of the main products of the process, there is only a negligible amount of waste produced in the process. This is a significant improvement compared to the prior processes for processing zinc-containing waste materials.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to one embodiment or an embodiment means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment. Where reference is made to a numerical value using a term such as, for example, about or substantially, the exact numerical value is also disclosed.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and examples of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In this description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The following non-limiting examples are intended merely to illustrate the advantages obtained with the embodiments of the present invention.

EXAMPLES

The process of the invention was carried out using EAF-dust provided by a respected industrial source from the EU area. The partial XRF analysis (Eurofins Expert Services Oy, Espoo, Finland) of the as-received EAF-dust are presented in Table 1. Based on the XRD results (Eurofins Expert Services Oy, Espoo, Finland), the material contained mainly zinc oxide (ZnO) and magnetite ($Fe_3O_4$).

TABLE 1

Partial results of the XRF analysis

| | Concentration (m-%) | | | | |
|---|---|---|---|---|---|
| Material | Ca | Fe | Mn | Pb | Zn |
| EAF-D | 1.7% | 24.0% | 3.0% | 1.3% | 39.0% |

The process described below is a hydrometallurgical process, which thus may include obvious steps and experimental equipment not explicitly mentioned herein, as well as repeating mentioned steps.

Example 1—Sulphatization and Dissolution of the as-Received EAF Dust

A treatment with sulphuric acid is carried out on the dust described above.

The sulphatization experiment was executed by applying a strong sulphuric acid ($H_2SO_4$ 93%, CAS:XXX, Manufacturer:XXX) from the weighed (ES 4200C, Precisa Gravimetrics AG, Dietikon, Switzerland) bottle (1000 mL DURAN® Original Laboratory Bottle, DWK Life Sciences GmbH, Wertheim/Main, Germany) with peristaltic pump (HV-07522-20, Masterflex® Bioprocessing, IL, USA) to the as-received EAF-dust "EAF-D" placed in the 5-litre drum size ploughshare horizontal mixer (GEBRÜDER LÖDIGE MASCHINENBAU GMBH., Paderborn, Germany) with the acid to EAF-D mass ratio of approximately 1.2.

The acid was pumped to the continuously mixed, EAF dust-containing, drum with the volumetric flow of 50 mL/min. The dispensing was executed with time interval (10 sec. on/5 sec. off) cycles until the desired amount of the acid was dispensed. After the sulphatization, the drum was emptied, and the sulphatized suspension, "EAF-SS" was transferred to the dissolution in which the suspension was contacted with the demineralized water "D-$H_2O$". The dissolution was executed in 5 litre acid proof steel reactor (Tasoteräs Oy, Helsinki, Finland) whose design (Outotec, Espoo, Finland) included four baffles and a rounded bottom. The slurry was agitated with a constant mixing speed of 400 rpm with an overhead mixer (ES100, IKA®-Werke GmbH & Co. KG, Staufen, Germany) and a gas-liquid-solid propeller (OKTOP 2000, Outotec Oy, Espoo, Finland) for 15 minutes. The dissolution was followed by Büchner filtration and drying of the residual solid phase "cake" in the nitrogen atmosphere oven (SLW 115, POL-EKO-APARATURA sp.j. Wodzislaw Śląski, Poland) for at least 24 hours. Both the liquid and the solid phases were analysed with ICP-OES. In addition, the liquid phase ferric iron concentration was determined with 5-sulfosalicylic acid dihydrate indicator—EDTA titration method.

Table 2 presents the input and the output amounts of the sulphatization and the dissolution phases.

TABLE 2

Input and output amounts during the sulphatization and dissolution

| Sulphatization | | | Dissolution | | | |
|---|---|---|---|---|---|---|
| | | | | | Output | |
| Input (g) | | Output (g) | Input (g) | | $V_{filtrate}$ | $m_{cake}$ |
| $m_{EAF-D}$ | $m_{H_2SO_4}$ | $M_{EAF-SS}$ | $M_{EAF-SS}$ | $m_{D-H_2O}$ | (mL) | (g) |
| 500.5 | 645.9 | 1083.9 | 1083.7 | 4335.0 | 4436.7 | 71.8 |

Tables 3 and 4 illustrate the recorder concentrations of selected metals in both phases after the dissolution.

TABLE 3

Concentrations of the selected metals in the liquid phase after the dissolution analysed with ICP-OES

| | Concentration (g/L) | | | | | |
|---|---|---|---|---|---|---|
| Material | Ca | Fe | Mn | Pb | Zn | $Fe^{III}$ |
| Filtrate | 0.7 | 20.9 | 2.8 | 0.0 | 48.4 | 22.2 |

TABLE 4

Concentrations of the selected metals in the solid phase after the dissolution analysed with ICP-OES

| | Concentration (g/g × 100%) | | | | |
|---|---|---|---|---|---|
| Material | Ca | Fe | Mn | Pb | Zn |
| Cake | 8% | 24% | 2% | 8% | 7% |
| Yield | 33% | 86% | 90% | 0% | 97% |

Example 2—Enhanced Sulphatization and Reductive Leaching of Pre-Treated EAF Dust The enhanced sulphatization was executed by applying hot concentrated sulphuric acid ($H_2SO_4$ 95-97%, CAS-No: 7664-93-9, Merck KGaA, Germany) to, either heated or as-received, EAF dust with the targeted acid to EAF-D mass ratio of approximately 1.5. The planned amount (444-522 g) of the EAF-dust was firstly divided (20-70 g) into the glass beakers (100-250 ml DURAN® Beaker, DWK Life Sciences GmbH, Wertheim/Main, Germany), which together with the acid bottle (1000 mL DURAN® Original Laboratory Bottle, DWK Life Sciences GmbH, Wertheim/Main, Germany), were transferred and detained in the internal gas circulation oven (Oy Meyer vastus Ab, Monninkylä, Finland) for 24 hours, with the setpoint temperature of 100° C.

After the preconditioning, the beakers were weighted and the acid bottle was placed on top of the scale (SB32001, Mettler-Toledo International Inc., Columbus, OH, USA) in order to monitor the acid consumption. The pre-determined amount of the acid was pipetted (5 mL Measuring Pipette from Soda-lime Glass, class AS, type 1, DWK Life Sciences GmbH, Wertheim/Main, Germany) with 10 g additions and after each additions the suspension was mixed manually with glass rod (KIMAX® Glass Stirring Rod, DWK Life Sciences GmbH, Wertheim/Main, Germany). After all the beakers were treated, they were placed back to the oven, with 200° C. temperature setpoint, for one hour digestion followed by 24 hours detaining in lower, 150° C., temperature. After the digestion the suspensions were combined and moved to further treatment.

The reductive leaching with sulphur dioxide gas ($SO_2$ 100%, CAS No: 7446-09-5, Linde plc. Dublin, Ireland) was completed in a 1 litre glass heating mantle reactor (Büchi AG, Uster, Switzerland) equipped with a hollow shaft gas stirrer (Gassing stirrer, Mettler-Toledo International Inc., Columbus, OH, USA) and a magnetic coupling (BMD150, Büchi AG, Uster, Switzerland) that was connected to an overhead mixer (ES100, IKA®-Werke GmbH & Co. KG, Staufen, Germany). The $SO_2$ gas was fed via thermal mass flow controllers "MFC" (GF40 SA44, Brooks Instrument LLC, Hatfield, PA, USA) that was operated via microcomputer-based controller (0245, Brooks Instrument LLC, Hatfield, PA, USA) whose displayed volumetric flowrate values were recorded manually at certain intervals. The $SO_2$ was guided underneath the solution surface and the MFC's full scale capacity was set to 268 sccm of $SO_2$. The gas outflow route was equipped with an Allihn-condenser (DWK Life Sciences GmbH, Mainz, Germany) to decrease the vapor generation. The reactor was heated with thermostatic water bath (Lauda Master, LAUDA DR. R. WOBSER GMBH & CO. KG, Königshofen, Germany) to achieve and maintain the setpoint temperature. The digital combined sensor (CPS16D, Endress+Hauser AG, Reinach BL, Switzerland) measured the pH, redox and the temperature values, that were collected with multiparameter transmitter (CM442, Endress+Hauser AG, Reinach BL, Switzerland) and sent to data collection software (LabView, NATIONAL INSTRUMENTS CORP., Austin, TX, USA).

The experiment was completed by filling up the reactor with both the subsample of the sulphatized suspension (140 g) and the demineralized water (700 g). The constant $SO_2$ flow was initiated after the slurry setpoint temperature (80° C.) was obtained. The $SO_2$ gas was fed with the volumetric flowrate setpoint of 16.22 sccm (error of flowrate 5.8%) for 5 hours, while the mixing speed was kept at 800 rpm. The samples were taken from the reactor with syringe at certain intervals. After the experiment, the slurry was drained through the reactor's bottom drain valve, followed by Buchner filtration. All the samples were filtered with the pore size of 0.45 μm and the liquid phase was analysed with ICP-OES and the solid phase with XRD/XRF. In addition, the liquid phase ferric iron concentration was determined with 5-sulfosalicylic acid dihydrate indicator—EDTA titration method.

Table 5 presents the input and the output amounts of the enhanced sulphatization and reductive leaching

TABLE 5

Input and output amounts during the enhanced sulphatization and reductive leaching

| Enhanced sulphatization | | | Reductive leaching in 80° C. (duration 5 hours) | | | | |
|---|---|---|---|---|---|---|---|
| | | Output | Input | | | Output | |
| Input (g) | | (g) | $M_{EAF\text{-}SS}$ | $m_{D\text{-}H_2O}$ | $\dot{V}_{SO_2}$ | $V_{filtrate}$ | $m_{cake}$ |
| $m_{EAF\text{-}D}$ | $m_{H_2SO_4}$ | $M_{EAF\text{-}SS}$ | (g) | (g) | (sccm) | (mL) | (g) |
| 444.3 | 694.5 | 1046.2 | 140 | 700 | 16.2 | 665.0 | 4.2 |

Table 6 and Table 7 illustrate the recorder concentrations of selected metals in both phases after the reductive leaching

TABLE 6

Concentrations of the selected metals in the liquid phase after the reductive leaching analysed with ICP-OES

| | Concentration (g/L) | | | | | |
|---|---|---|---|---|---|---|
| Material | Ca | Fe | Mn | Pb | Zn | $Fe^{III}$ |
| Filtrate | 0.4 | 18.0 | 0.9 | ND | 30.6 | 0 |

TABLE 7

Concentrations of the selected metals in the solid phase after the reductive leaching analysed with XRF

| | Concentration (m-%) and yield to solution | | | | |
|---|---|---|---|---|---|
| Material | Ca | Fe | Mn | Pb | Zn |
| Cake | 12% | 0.7% | 0.15% | 16% | 0.2% |
| Yield | 50% | 100% | 100% | 0% | 100% |

Example 3—Combined Neutralization and the Ferric Iron Reduction of the Dissolved Sulphatized Suspension The solution, originated from a process described in the section 1, was neutralized and reduced with steel wool (steel wool wire Gr.5, approx. cross-section data: 0,055 mm, comparable material Nr. 1.0492/11Mn4Si, OSCAR WEIL GmbH, Lahr, Germany) in a 1 litre glass heating mantle reactor (DURAN® GLS 80® Double Walled Bottle Wide Mouth, DWK Life Sciences GmbH, Wertheim/Main, Germany). The nitrogen gas "$N_2$" was fed to the reactor via thermal mass flow controller, operated in a same manner as described in the section 2, whose full-scale capacity was set to 860 sccm of $N_2$. The reactor was equipped with an Allihn-condenser (DWK Life Sciences GmbH, Mainz, Germany) to decrease the vapor generation. The reactor was heated with thermostatic water bath (Lauda 10 ECO Silver, LAUDA DR. R. WOBSER GMBH & CO. KG, Königshofen, Germany) to achieve and maintain the setpoint temperature. The digital combined sensor (CPS16D, Endress+Hauser AG, Reinach BL, Switzerland) measured the pH, redox and the temperature. The mixing of the solution was conducted with peristaltic pump (HV-07522-20, Masterflex® Bioprocessing, IL, USA) by circulating the solution with the volumetric flow of 500 mL/min.

The experiment was started by heating the filled-up reactor to the setpoint temperature (60° C.). The 100 sccm $N_2$ flow was applied during the heating. After the setpoint temperature was achieved, the measured amount of steel wool "$m_{Fe}$" was inserted to the solution and the pumping was initiated. The samples were obtained at certain intervals and the samples were filtered with the pore size of 0.45 μm and the liquid phase was analysed with ICP-OES. In addition, the liquid phase ferric iron concentration was determined with 5-sulfosalicylic acid dihydrate indicator—EDTA titration method.

Table 8. Presents the fed amounts and the initial as well the after 20 minutes values, while Table 9 presents the metal concentrations after the neutralization and reduction.

TABLE 8

Combined neutralization and reduction with Gr. 5 steel wool in 60° C.

| EXP. name | $V_{solution}$ (mL) | $m_{Fe}$ (g) | Duration (min) | $pH_{initial}$ | $c[Fe^{III}]_{initial}$ (g/L) | $pH_{t-20\ min}$ | $c[Fe^{III}]_{t-20\ min}$ (g/L) |
|---|---|---|---|---|---|---|---|
| CRN_5.11 | 800 | 37.4 | 20 | 1.21 | 22.12 | 2.62 | 0 |

TABLE 9

Selected metals concentration in the solution after the combined neutralization and reduction

| | Concentration (g/L) | | | | | |
|---|---|---|---|---|---|---|
| Material | Ca | Fe | Mn | Pb | Zn | $Fe^{III}$ |
| CRN_5.11 | 0.5 | 33.9 | 2.6 | 0.0 | 43.9 | 0.0 |

Example 4—Zinc Recovery

The zinc was recovered as a sulphide by applying hydrogen sulphide gas ($H_2S$2.5, Linde plc. Dublin, Ireland) to the solution, prepared with the method described in the section 3. The experiment was completed with the similar equipment as described in the section 2. The reactor was firstly filled and the solution heated. The $N_2$ was fed to the reactor prior to the $H_2S$ initiation.

Table 10 presents the initial amounts and the recorded values before and after the test.

TABLE 10

Initial amounts and recorded values before and after the sulphide precipitation

| EXP. name | $V_{solution}$ (mL) | $\dot{V}_{H_2S}$ (sccm) | Duration (min) | $pH_{initial}$ | $c[Zn]_{initial}$ (g/L) | $pH_{t-40\ min}$ | $c[Zn]_{t-40\ min}$ (g/L) |
|---|---|---|---|---|---|---|---|
| ZR_2.7 | 850 | 571 | 40 | 2.74 | 52.99 | 0.41 | 0.59 |

Table 11 presents a comparison of selected metals between the input and the output solution in the sulphide precipitation.

TABLE 11

Concentrations of selected metals in input and output solution

| | Concentration (g/L) | | | | | | |
|---|---|---|---|---|---|---|---|
| Material | Ca | Cd | Fe | Mn | Pb | Zn | $Fe^{III}$ |
| Input (CRN_5.4) | 0.5 | 0.01 | 32.6 | 3.0 | 0 | 52.9 | 0 |
| Output (ZR_2.7) | 0.6 | 0.00 | 32.6 | 2.6 | 0 | 0.59 | 0 |

Table 12 presents the XRF analysis executed to the one of the sulphide precipitation tests. Based on the XRD analysis, the phase contained zinc sulphide (ZnS).

TABLE 12

Concentrations of selected metals in the solid phase after the sulphide precipitation with XRF

| | Concentration (m-%) | | | | |
|---|---|---|---|---|---|
| Material | Ca | Fe | Mn | Pb | Zn |
| ZR_2.1 | 0.01% | 0.08% | 0.01% | —% | 66.0% |

INDUSTRIAL APPLICABILITY

The present invention provides a low-waste hydrometallurgical process for the treatment of arc furnace dust together with scrap iron, as well as for recovering zinc and iron as their sulphides.

Particularly, the process provides an inner iron circulation, as iron can be used in reduction and neutralization chemicals. Thus, the chemicals added to the process can be converted with the iron and zinc of the raw material into products.

CITATION LIST

EP 0709472 B1
KR 101959257 B1
WO 2018109283 A1

The invention claimed is:

1. A process for recovering zinc and iron products from zinc and iron-containing waste materials obtained from the zinc or steel industry, or both, the process comprising:

treating the waste materials with strong sulphuric acid of >50 w-% to convert any zinc, iron, and/or other-oxide compounds into leachable sulphate compounds, leaching the acid-treated material in an aqueous solution at reducing conditions, in order to provide a leach solution containing dissolved zinc and dissolved iron as sulphates, neutralizing the acid of the leach solution and further reducing ferric iron in the solution, by using an iron-based reagent, thus providing a neutralized leach solution, recovering zinc from a neutralized solution obtained from a preceding step in one or more steps of sulphide precipitation, in order to provide a zinc-deprived solution, and neutralizing the acid of the zinc-deprived solution obtained from the preceding precipitation step using an iron-based reagent, recovering iron from a solution obtained from the previous step by sulphate crystallization, thus leaving a raffinate solution with a lowered iron concentration, and circulating at least a fraction of the raffinate solution obtained from the iron recovery back to the leaching step.

2. The process of claim 1, wherein the waste material is selected from one or more zinc-containing by-products of the zinc or steel industries.

3. The process of claim 1, wherein a pre-treatment step is carried out on the zinc and iron-containing waste material, where it is washed with water to remove water-soluble alkali metal salts before the acid treatment, in order to decrease the concentration of alkali metals in the following streams and thus to reduce the requirement for solution purification.

4. The process of claim 1, wherein the sulphuric acid has been heated to a temperature of >100° C. to release halogen impurities as gaseous effluents, and wherein the sulphuric acid has been mixed with preheated waste material to a temperature of 100-150° C.

5. The process of claim 1, wherein the leaching is carried out on the acid-treated material, optionally mixed with a further waste material, in an aqueous sulphate solution.

6. The process of claim 1, wherein the leaching is carried out on the acid-treated material, optionally mixed with a further waste material, at a temperature of more than 50° C.

7. The process of claim 1, wherein the neutralization steps are carried out with a pH adjustment and redox control using an addition of iron hydroxide or metallic iron in an amount resulting in an adjustment of the pH to a level of about 2.5-3.0.

8. The process of claim 1, wherein one to three zinc precipitations are carried out, each precipitation step followed by a neutralization step.

9. The process of claim 8, wherein the zinc precipitation(s) is/are carried out by adding hydrogen sulphide ($H_2S$).

10. The process of claim 1, wherein the neutralization generates hydrogen ($H_2$), which is recycled to a hydrogen sulphide generation step or is recovered as a product.

11. The process of claim 1, wherein the iron crystallization is carried out by using cooling or evaporation, thus causing the formation of crystals of ferrous or ferric sulphate.

12. The process of claim 1, wherein at least a fraction of ferrous or ferric sulphates present in the zinc-deprived solution are precipitated into iron hydroxide.

13. The process of claim 1, wherein a fraction of the raffinate solution is circulated back to the leaching step via further purification steps.

14. The process of claim 13, wherein a 5-20 vol-% fraction of the raffinate solution is circulated back to the leaching step via further purification steps.

15. The process of claim 1, wherein a fraction of the raffinate solution is circulated back to the leaching step via further purification steps, including a step of precipitating nickel and cobalt from the solution.

16. The process of claim 1, wherein a fraction of the raffinate solution is circulated back to the leaching step via further purification steps, including a step of precipitating a further fraction of iron from the solution, by oxidizing the ferrous iron and precipitating it as ferric hydroxide or ferric oxyhydroxide.

17. The process of claim 1, wherein a fraction of the raffinate solution is circulated back to the leaching step via further purification steps, including a step of precipitating manganese from the raffinate solution, using a feed of oxidative gas.

18. The process of claim 1, wherein a fraction of the raffinate solution is circulated back to the leaching step via further purification steps, including a step of separating a further fraction of zinc from a remaining bleed solution, by precipitating the zinc as zinc sulphide.

19. The process according to claim 1, wherein the waste material comprises electric arc furnace dust (EAF-dust).

* * * * *